US008960211B2

(12) United States Patent
Eng

(10) Patent No.: US 8,960,211 B2
(45) Date of Patent: Feb. 24, 2015

(54) COMBINATION HIKING POLE AND CAMERA STEADYING DEVICE

(71) Applicant: Bruce Colin Eng, Houston, TX (US)

(72) Inventor: Bruce Colin Eng, Houston, TX (US)

( * ) Notice: Subject to any disclaimer, the term of this patent is extended or adjusted under 35 U.S.C. 154(b) by 0 days.

(21) Appl. No.: 14/152,472

(22) Filed: Jan. 10, 2014

(65) Prior Publication Data

US 2015/0000717 A1 Jan. 1, 2015

Related U.S. Application Data

(60) Provisional application No. 61/840,516, filed on Jun. 28, 2013.

(51) Int. Cl.
*A45B 3/00* (2006.01)
*A45B 1/00* (2006.01)

(52) U.S. Cl.
CPC ..... *A45B 1/00* (2013.01)
USPC ..... 135/66; 248/155; 248/187.1; 396/421; 396/429

(58) Field of Classification Search
CPC ..... A45B 1/00; A45B 3/00; F16M 13/04; F16M 13/08
USPC ..... 135/66, 75, 114; 248/155, 155.1, 187.1, 248/500, 505, 507, 508, 511, 520, 523, 248/155.2; 396/419, 421, 423, 429, 544
See application file for complete search history.

(56) References Cited

U.S. PATENT DOCUMENTS 473,357 A * 4/1892 Servus ..... 248/155
657,947 A * 9/1900 MacGill ..... 248/155
947,281 A * 1/1910 George ..... 135/114
1,063,106 A * 5/1913 Bell ..... 248/155
1,138,417 A * 5/1915 Rottenburg ..... 248/155
1,319,397 A * 10/1919 Kelsey ..... 248/155
1,679,267 A * 7/1928 Rieger ..... 248/155
1,766,090 A * 6/1930 Worsching ..... 396/421
2,016,744 A * 10/1935 Heck ..... 248/155
3,317,169 A * 5/1967 Hendricks ..... 248/188.2
3,810,647 A * 5/1974 Martchenke ..... 280/816
3,964,441 A * 6/1976 Wall ..... 119/796
4,155,636 A * 5/1979 Reeberg ..... 396/423
4,266,867 A * 5/1981 Reeberg ..... 396/423
5,738,328 A * 4/1998 O'Farrill ..... 248/500
5,808,227 A * 9/1998 Amos ..... 89/36.01
6,752,369 B1 * 6/2004 Cameron ..... 248/500
6,769,824 B2 * 8/2004 Nakatani ..... 396/419
6,964,277 B2 * 11/2005 Naber ..... 135/16
7,344,320 B2 * 3/2008 Barker et al. ..... 396/419
7,905,667 B2 3/2011 Barker
8,157,225 B2 * 4/2012 Kephart ..... 248/187.1
8,280,242 B2 * 10/2012 Young et al. ..... 396/544
8,491,205 B2 * 7/2013 Barreiro ..... 396/421
2002/0179785 A1 * 12/2002 Hetrick et al. ..... 248/146
2011/0243551 A1 * 10/2011 Young et al. ..... 396/544
2013/0101277 A1 * 4/2013 Barreiro ..... 396/55

* cited by examiner

*Primary Examiner* — Robert Canfield

(57) ABSTRACT

The invention combines the functionality of a hiking pole and a camera tripod. A hiking pole is augmented with an attachment for a camera and with a plurality of flexible tethers, each of which have one end that attaches near the top of the pole and the other end which can be stood on or otherwise immobilized relative to the ground. The combination of the tethers and the rigid pole will restrict all freedom of motion of the camera and allow stabilized, long exposure pictures to be taken. When not taking pictures, in the preferred embodiment of the invention, the tethers can be retracted and stored, leaving the user with a functioning hiking pole.

11 Claims, 2 Drawing Sheets

Fig. 1
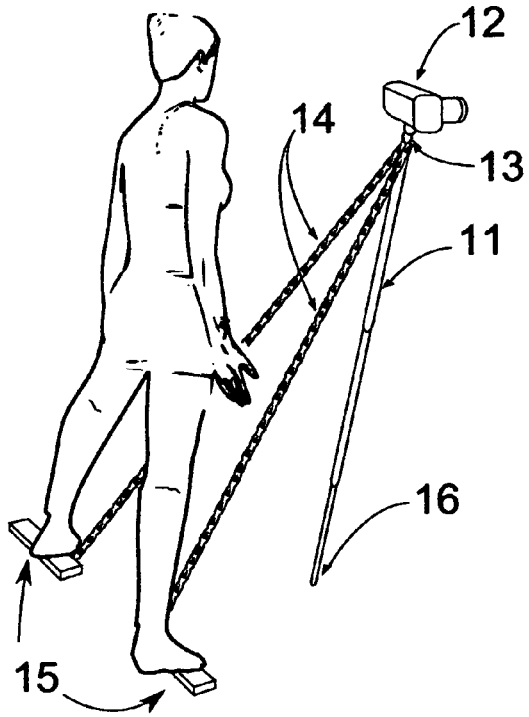
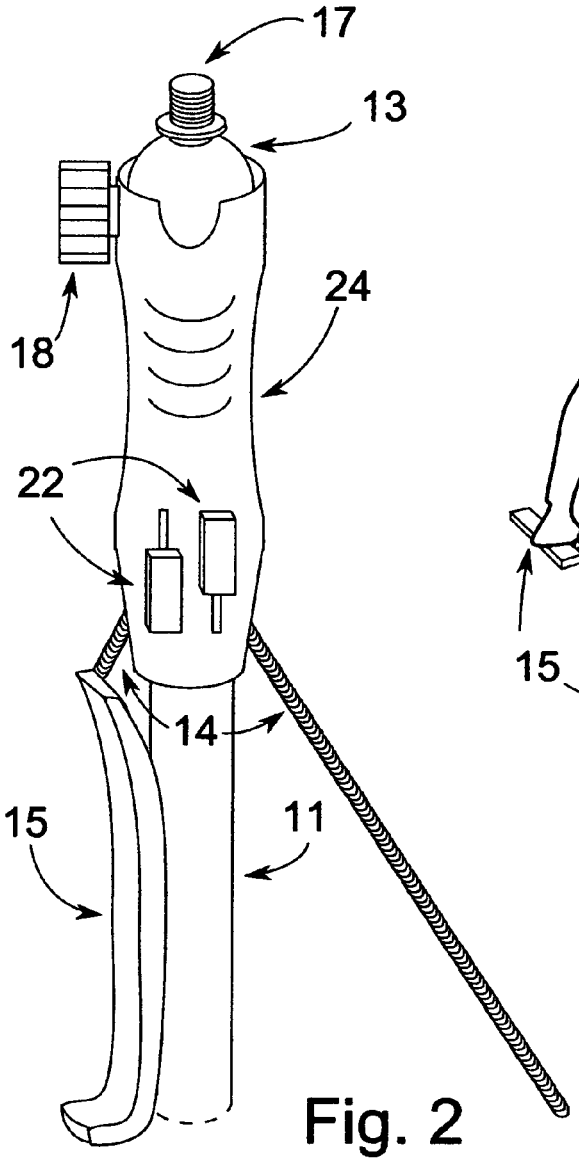
Fig. 2

COMBINATION HIKING POLE AND CAMERA STEADYING DEVICE

CROSS-REFERENCE TO RELATED APPLICATIONS

This application claims the benefit of U.S. Provisional Application No. 61/840,516, filed Jun. 28, 2013.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF INVENTION

The present invention relates to a pole for use in hiking and photography. More specifically, the present invention relates to a hiking pole that is configurable into a form which can steady a camera for improved photographs and images.

BACKGROUND OF THE INVENTION

Many people enjoy photography while hiking. There are certain types of photographs taken while hiking which demand a long exposure time where the camera is held almost completely still to achieve a good photo. Examples are long exposures of waterfalls or streams to get smooth looking water, pictures taken at night, and blurring the motion of moving subjects relative to stationary backgrounds. Normally getting such a photo requires the use of a tripod. While hiking, carrying a tripod can be cumbersome and add additional weight. However, hikers often use hiking poles for stability on uneven terrain.

The present invention describes an apparatus that can be used as a hiking pole and which can also stabilize a camera to the degree required for good looking long exposure photographs. This invention serves both the function of the hiking poles and the tripod without adding much additional weight or bulk to be carried by the hiker.

There are many examples in prior art which combine hiking poles with a monopoles. These consist of a hiking pole with a standard screw on camera mount on top. These help stabilize a camera when taking pictures but do not provide the degree of stability required to take good exposures of over half a second in length because a monopole will sway side to side even when the user tries to hold it completely still.

Prior art also describes using ropes or other tethers to help stabilize a camera. U.S. Pat. No. 8,491,205 describes a tripod consisting completely of tethers. However these other devices generally require the user to provide an upward force against the tether. This means that the camera is not completely isolated from the user which causes a degradation of the photograph due to unintended vibrations.

Prior art, for example U.S. Pat. No. 7,905,667, also describes walking sticks which can transform into tripods but these systems are mechanically complex and often have legs narrower than the full width of the hiking pole which makes them prone to failure. Such devices are likely more expensive to manufacture than the current invention.

SUMMARY OF THE INVENTION

The current invention describes an apparatus which can function as a hiking pole and which also can steady a camera during long exposure shots through use of a plurality of tethers attached to a rigid pole.

BRIEF DESCRIPTION OF DRAWINGS

FIG. 1 is a perspective view of the invention being used to stabilize a camera FIG. 2 is a detail view of the upper portion of the invention without the camera mounted

DETAILED DESCRIPTION OF THE INVENTION

Figure 3:
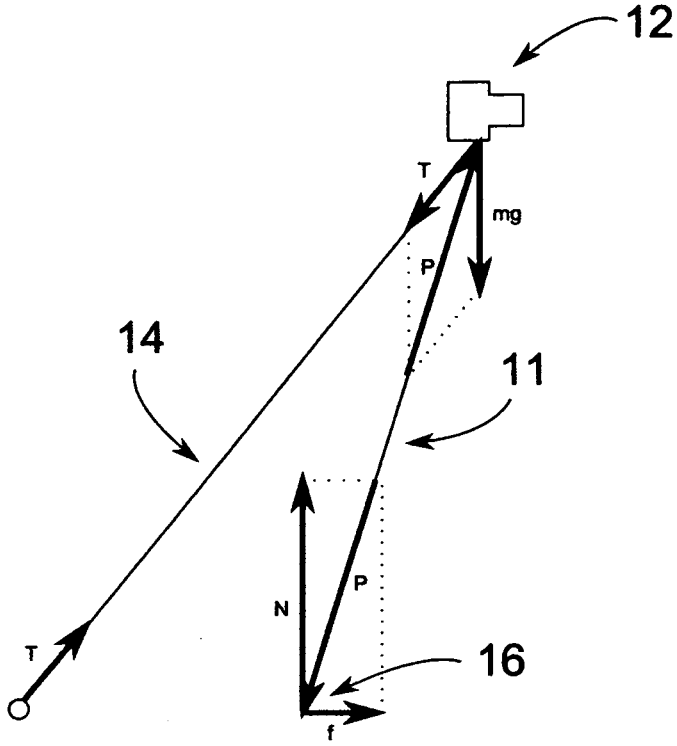
FIG. 3 is a two dimensional free body diagram of the invention with the camera mounted

Referring now to the invention in more detail, in FIG. 1 the invention is being used to stabilize a camera 12. The invention consists of a hiking pole 11, preferably collapsible, with two tethers 14 connected to it, preferably near the top of the pole. The other end of each tether is designed to be anchored to the ground.

In the preferred embodiment, the anchoring is accomplished by standing on pieces of semi-rigid material, which will be referred to a "stirrups" 15 at the end of each tether 14. The tethers can be made of any flexible material, but a light weight chain or cable will stretch less than a rope and therefore may provide better stability. The stirrups 15 are preferably slightly longer than the width of the user's foot so when the user stands on them, the side of their foot is not in contact with the tether 14 and no vibration is transmitted to the camera. Preferably, the stirrups 15 are semi-rigid and conform to the ground. With this arrangement, very little of the user's natural shaking and swaying motions will be transmitted through the tethers 14 and hence the camera 12 will be perfectly still. It would also be possible to anchor the tethers 14 to the ground using other heavy objects or using stakes to further isolate the camera from the user.

When used to steady a camera 12 the user deploys the tethers 14 and stands on the end of each tether and lets the pole 11 rest with one end on the ground and leaning slightly away from her. The end of the pole has a hard tip 16 so that it will resist sliding relative to the ground. For indoor use, a rubber tip could be used to prevent scratching the floor. The two tethers 14 will go taut and a static position will develop. Preferably the two tethers 14 attach at different points around the circumference of the pole 11 so that when they are under tension the pole 11 is no longer free to rotate about its axis.

FIG. 3 shows a two dimensional free body diagram of the camera and pole system. The camera 12 experiences a downward gravitational force mg. To counteract this force, an upward force P is developed in the pole 11. However because the pole 11 is set at an angle, there is a component of P which is in the horizontal direction. To resist this force, a force T is developed in the tether 14. The opposite end of the tether 14 is anchored to the ground. The tip of the pole 11 is resting on the ground. A normal force N develops to counteract the downward force P exerted by the pole and a frictional force f develops between the tip of the pole and the ground in order to resist horizontal motion. In this two dimensional free body diagram, only a single tether is shown. In the three dimensional world there are two tethers 14 that are anchored outside the plane showing in FIG. 3, but the forces in the axis coming out of the page will cancel out, reducing the overall force of both tethers to force T.

The user will probably want to take their photograph using a delay timer feature so that any initial vibrations and movement have time to dampen before the exposure begins. The user may also want to hold the strap of the camera to prevent it from falling should the tip 16 slip. It may also be desirable to attach a strap (not shown) to the device which the user can attach to their body, again in order to prevent the camera from hitting the ground should the tip 16 of the pole slip.

Most modern hiking poles are adjustable in length so that they can comfortably accommodate users of different body sizes. Also, most tripods have legs which are adjustable in length so the tripod can change height and accommodate uneven ground. One way to confer similar advantages to the current invention is to make the tethers adjustable in length.

Figure 4:
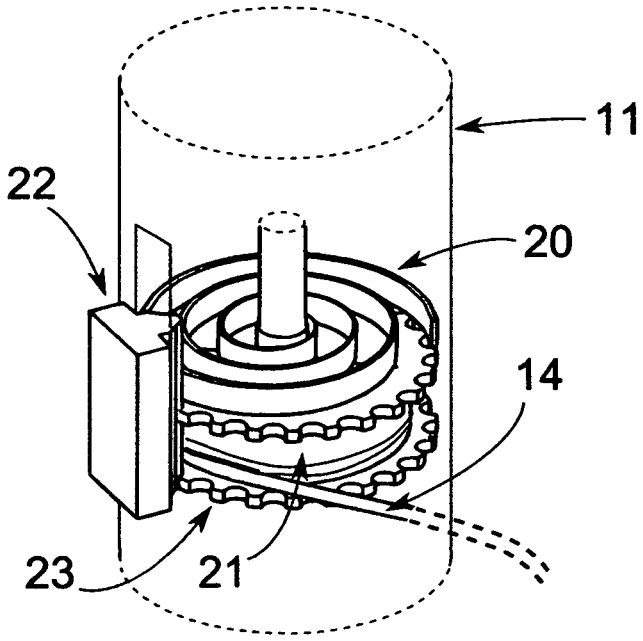
FIG. 4 is a detail view of a tether winding mechanism comprised in one embodiment of the invention

FIG. 4 shows one embodiment which comprises a tether of adjustable length. Note that in FIG. 4 the tethers are depicted as cables rather than the chains from FIG. 1 since cables will be easier to wind onto a spool. The tether winding mechanism shown in FIG. 4 is housed inside the hiking pole 11. This mechanism works in the same manner as some retractable dog leashes: a spiral wound spring 20 causes a spool 21 to rotate, in turn causing the tether 14 to wind up when there is no tension on the end of it. Under tension the tether 14 would overcome the force of the spring and be let out until a hand operated switch 22 is slid downward, locking into a toothed-wheel 23, thereby stopping rotation of the spool 21 and preventing further extension of the tether. This serves the dual purpose of allowing the tether to be completely stored when not in use and also allowing the tether to be let out to an adjustable length while using the device to steady a camera. Two copies of this mechanism could be stacked vertically within the pole in order to allow both tethers to adjust in length independently from one another.

FIG. 2 shows the upper portion of the invention in detail. On the top of the pole 11 is a part on which to mount the camera 12. This is preferably the industry standard screw thread 17. In the preferred embodiment of the device there is a rotating ball joint 13 as is common on tripods so the camera can be aimed and then locked in place by tightening a thumb screw 18 prior to taking the picture. When using the invention as a hiking pole, the user can hold the molded handgrip 24 and use a switch 22 to retract the tethers 14. In this figure the left tether is shown in the retracted position. In this position the 14 tether and 15 stirrups are out of the way and will not interfere with hiking.

While the foregoing description describes what is currently thought to be the best form of the device it should be appreciated for those of ordinary skill the existence of many variations based on the same spirit of the invention that achieve similar objectives. For example, a second embodiment of the device could be created by temporarily attaching two hiking poles together at the top and then stabilizing them through the use of a single tether anchored to the ground. It should also be noted that even if the user is not participating in hiking, the device still has some benefits over a tripod, namely that it can be made lighter in weight and more portable. Therefore the present invention should be construed to encompass any devices for stabilizing a photo that are constructed as previously described. In addition the device could also apply to filming video since it is often the case that the user wishes to hold the camera still while filming.

I claim:

1. An apparatus for steadying a camera while taking a photograph comprised of:

a. a rigid pole with a camera mount on one end and a tip on the other end which when placed in contact with the ground helps prevent the end of the pole from sliding along the ground;

b. a plurality of flexible tethers extending from said pole, where opposite ends of said tethers are adapted to be temporarily anchored to the ground, such that tethers are under tension during photograph taking;

c. a rigid or semi-rigid component adapted to be stood on that connects to each of the flexible tethers wherein the combination of said pole and said tethers restrict the motion of a mounted camera in all directions relative to the ground when said tethers are under tension.

2. The apparatus from claim 1 additionally comprised of a hand grip near the top of the pole wherein the pole is formed of a plurality of telescopic sections.

3. The apparatus from claim 1 additionally comprised of at least one spool member on which said tethers can be wound and thereby stored when the apparatus is being used as a hiking pole.

4. The apparatus from claim 1 wherein the length of the tethers under tension can be adjusted.

5. The apparatus from claim 1 additionally comprised of a rotating ball joint between the camera mount and the pole.

6. An apparatus for steadying a camera while taking a photograph that dually serves as a hiking pole comprised of:

a. a rigid pole comprised of a plurality of telescoping sections, a handgrip affixed near the top of the pole, a camera mount on the top of the pole, and a tip on the bottom end of the pole which when placed in contact with the ground prevents the end of the pole from sliding along the ground;

b. a plurality of flexible tethers wherein one point of the tether is permanently or can be temporarily connected to the said pole and another point of each tether is permanently or can be temporarily connected to an object which is presently immobile relative to the ground.

7. The apparatus from claim 6 wherein during the taking of a photograph the apparatus can be configured by the user in a position where the center of mass of the camera and pole system extends beyond the tip of the pole so that the natural tendency of the camera and pole system to fall away from the user is resisted by tension developed in the tethers which are anchored to the ground by means of the weight of the user's feet.

8. The apparatus from claim 6 wherein the pole has at least one hollow section where the tethers can be stored when the apparatus is being used as a hiking pole.

9. The apparatus from claim 6 additionally comprised of:

a. at least one spool member on which at least one of said tethers can be wound and thereby stored when the apparatus is being used as a hiking pole;

b. a hand operated switch which can be used to stop rotation of the said spool member thereby fixing the extended length of at least one of said tethers.

10. The apparatus from claim 6 additionally comprised of a rotating ball joint between the camera mount and the pole.

11. An apparatus for steadying a camera while taking a photograph comprised of:

a. a rigid pole with a camera mount on one end and a tip on the other end which when placed in contact with the ground helps prevent the end of the pole from sliding along the ground;

b. a plurality of flexible tethers extending from said pole, where opposite ends of said tethers are adapted to be temporarily anchored to the ground, such that tethers are under tension during photograph taking;

c. a plurality of stakes adapted to attach each tether to the ground wherein the combination of said pole, said stakes, and said tethers restrict the motion of a mounted camera in all directions relative to the ground when said tethers are under tension and said stakes are embedded in the ground.

* * * * *